United States Patent [19]

Yamanobe et al.

[11] Patent Number: 4,572,997

[45] Date of Patent: Feb. 25, 1986

[54] TRIGGER SWITCH

[75] Inventors: Ken Yamanobe, Kawasaki; Hiroyuki Arai, Kanagawa; Touru Kasai, Kawasaki, all of Japan

[73] Assignee: Fujisoku Electric Co., Ltd., Kawasaki, Japan

[21] Appl. No.: 658,498

[22] Filed: Oct. 9, 1984

[51] Int. Cl.[4] ..... H02P 7/00

[52] U.S. Cl. ..... 318/349; 318/17; 318/345 R; 318/345 H; 318/345 D; 200/157

[58] Field of Search ..... 318/17, 345 D, 345 H, 318/345 R, 331, 349; 310/50, 48; 361/381, 386, 387; 200/157, 6 BB, 6 C, 153 LA, 153 J, 1 V, 145 R, 145, 155 R, 68, 16 C

[56] References Cited

U.S. PATENT DOCUMENTS

| | | | |
|---|---|---|---|
| 3,329,842 | 7/1967 | Brown | 318/345 G |
| 3,447,057 | 5/1969 | Brown et al. | 318/345 H |
| 3,484,632 | 12/1969 | Opalenik et al. | 200/157 X |
| 3,536,973 | 10/1970 | Matthews et al. | 318/345 H |
| 3,543,120 | 11/1970 | Robertson | 318/345 |
| 3,660,742 | 5/1972 | Gawron | 318/345 |
| 3,755,640 | 8/1973 | Kaman et al. | 200/157 |
| 3,886,340 | 5/1975 | Bittel | 200/157 X |
| 4,095,072 | 6/1978 | Piber | 318/345 R X |
| 4,097,704 | 6/1978 | Piber | 318/345 R X |
| 4,100,383 | 7/1978 | Piber | 200/157 |
| 4,137,490 | 1/1979 | Brozoski et al. | 318/345 G |
| 4,241,297 | 12/1980 | Piber et al. | 318/345 D X |

FOREIGN PATENT DOCUMENTS

| | | |
|---|---|---|
| 436881 | 12/1966 | Japan . |
| 54-18742 | 7/1979 | Japan . |

*Primary Examiner*—William M. Shoop, Jr.
*Assistant Examiner*—Shik Luen Paul Ip
*Attorney, Agent, or Firm*—Frishauf, Holtz, Goodman & Woodward

[57] ABSTRACT

A variable resistor and a printed circuit board having a velocity control circuit are separated from each other in a switch case. The resistance of the variable resistor changes upon operation of a trigger. An element constituting the variable resistor is electrically connected to a predetermined pattern of the printed circuit board through a coil spring. The heat-generating portion of a thyristor is separated from the printed circuit board. A storage component is formed in a part of the trigger shaft which is located inside the switch case. A threaded portion of an adjusting screw which extends in the shaft of the trigger, threadably engages an engaging member which can slide in the storage compartment of the trigger shaft. A movable member is brought into slidable contact with the variable resistor by the engaging member, so as to change the resistance of the variable resistor when the trigger and/or the adjusting screw is operated.

8 Claims, 13 Drawing Figures

TRIGGER SWITCH

BACKGROUND OF THE INVENTION

The present invention relates to a trigger switch capable of controlling the velocity of a motor mounted in an electric tool or the like.

A conventional trigger switch of this type is described in U.S.P. No. 3,543,120. A thyristor is used in this trigger switch for controlling the velocity of the motor. Since the thyristor generates a great amount of heat, the heat must be effectively radiated. Conventionally, the thyristor is embedded in a printed circuit board, and heat is radiated through the printed circuit board. However, the printed circuit board is heated by heat from the thyristor to a high temperature, resulting in an adverse effect in other circuit components. In particular, when a resistor is formed in the printed circuit board, the resistance of the resistor changes in accordance with the temperature of the printed circuit board. As a result, the velocity control for the motor becomes unstable.

In motor velocity control, when the stroke of the trigger is adjusted and a desired velocity is obtained while the trigger is withdrawn, a desired velocity can be easily obtained, thereby providing good operability. However, it is very difficult to realize a stroke adjusting mechanism having a rigid structure which withstands the trigger operation.

SUMMARY OF THE INVENTION

It is a first object of the present invention to provide a trigger switch capable of effectively radiating heat from a heat-generating component, preventing a printed circuit board and a resistor from being heated, and providing stable velocity control.

It is a second object of the present invention to provide a trigger switch which is capable of easily setting a desired velocity and providing good operability, and which will not be damaged against a trigger operation force.

In order to achieve the above objects of the present invention, there is provided a trigger switch wherein a heat-generating portion of a heat-generating component is arranged to be separated from a printed circuit board, a resistor brought into sliding contact with a slider is arranged to be separated from the printed circuit board, an adjusting means is arranged in a trigger, and an engaging member is shifted by the adjusting means and drives the slider of a variable resistor and a movable member coupled to a switch mechanism.

DETAILED DESCRIPTION OF THE PREFERRED EMBODIMENT

Figure 1:
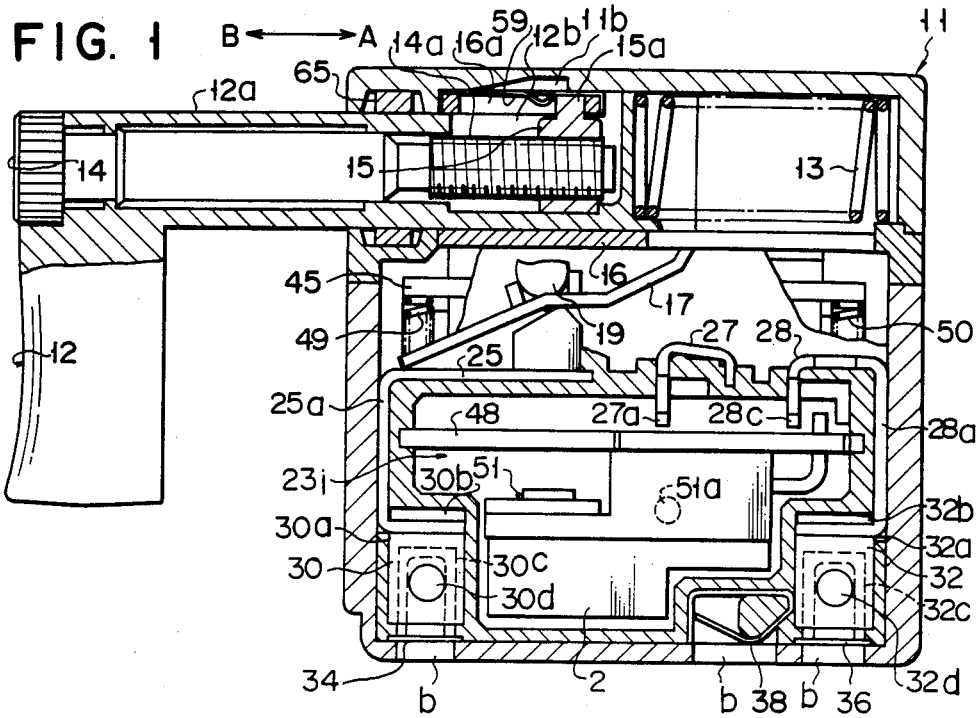
FIG. 1 is a side sectional view of a trigger switch according to an embodiment of the present invention.
Figure 3:
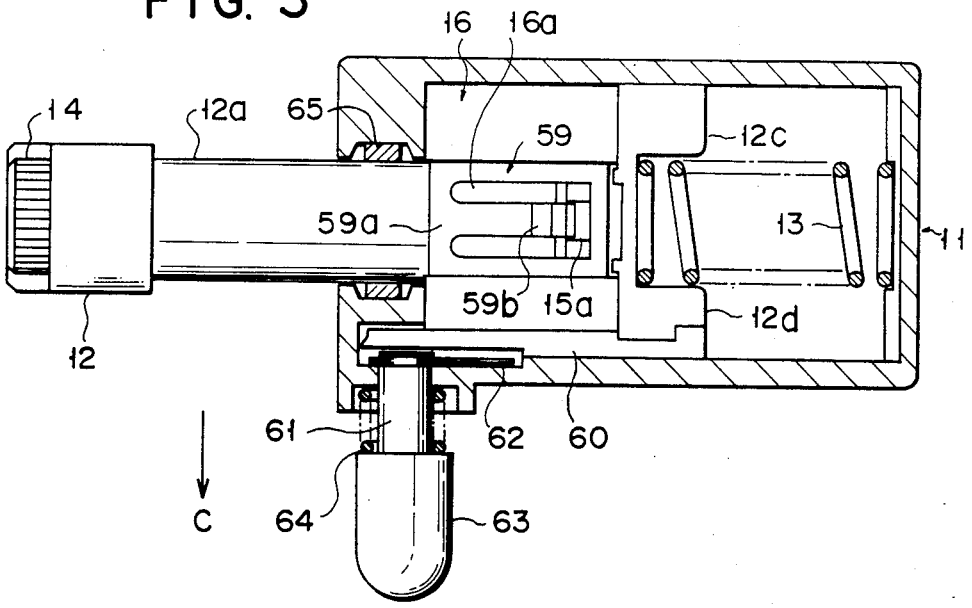
FIG. 3 is a plan view showing part of the trigger switch shown in FIG. 1.
Figure 2:
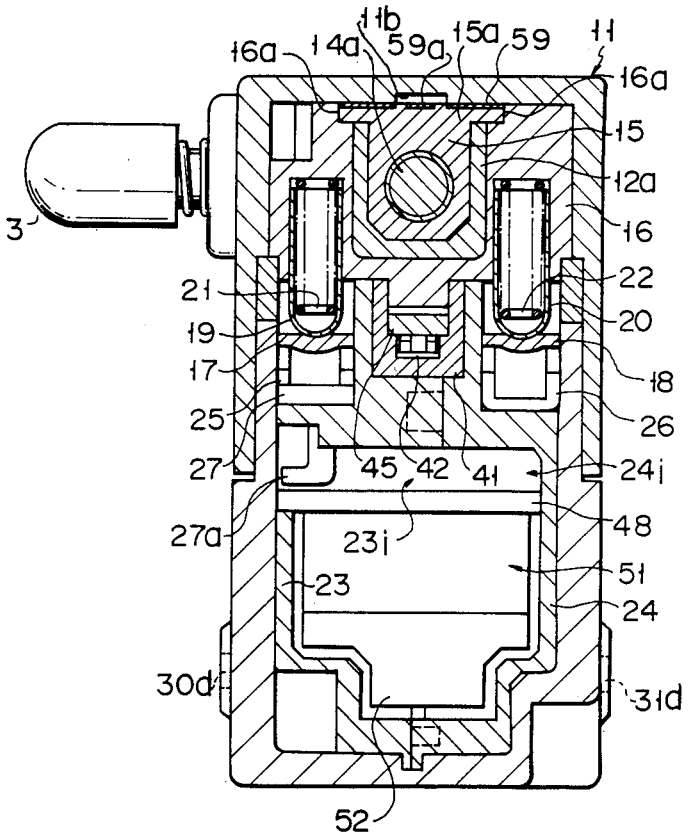
FIG. 2 is a side sectional view of the trigger switch of FIG. 1 when viewed from another direction.
Figure 4:
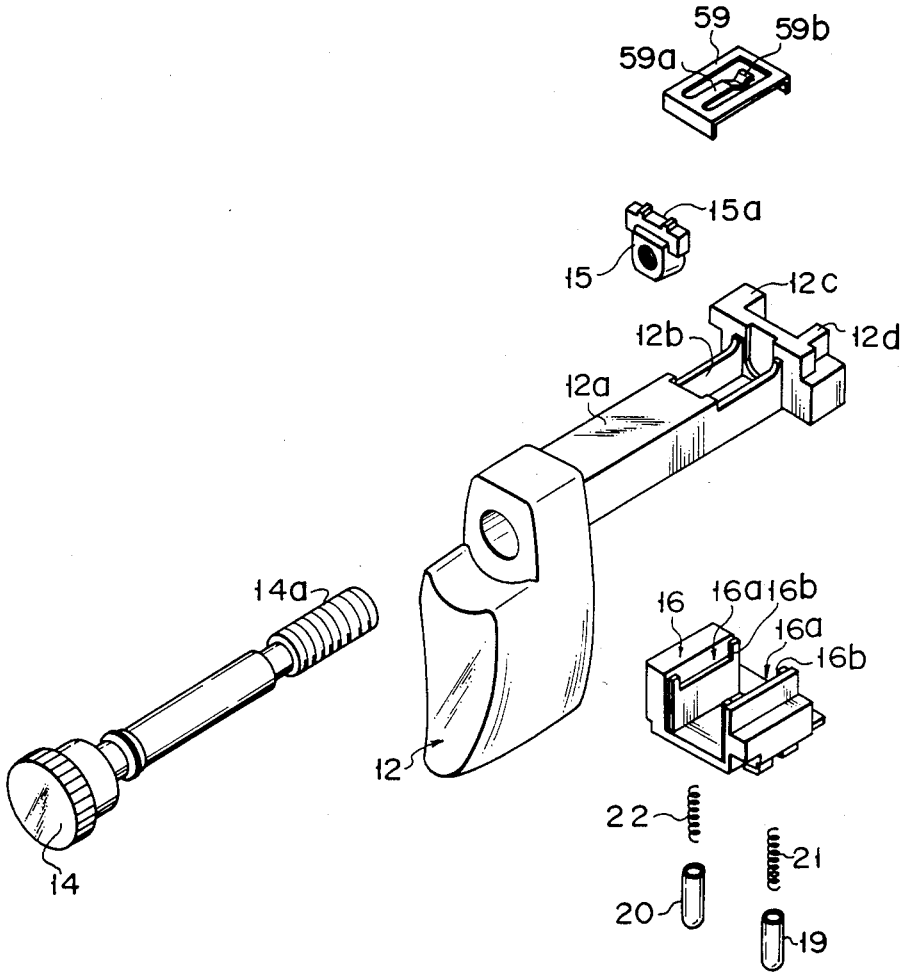
FIGS. 4(*a*) and 4(*b*) are exploded perspective views showing the internal configuration of the trigger switch.
Figure 4:
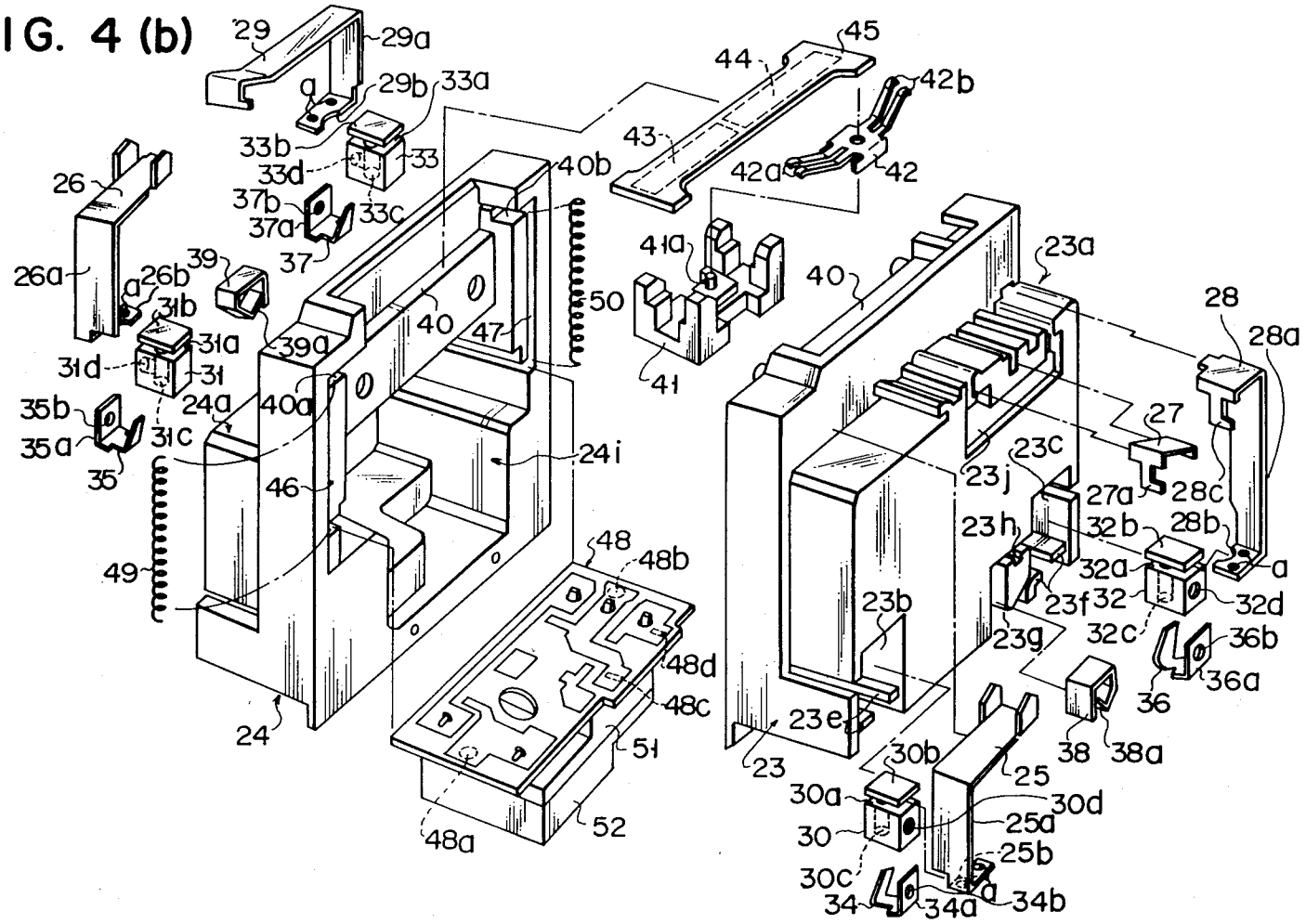

Referring to FIGS. 1, 4(*a*) and 4(*b*), a switch case 11 comprises a split case. A shaft 12*a* of a trigger 12 is mounted in the switch case 11 to be slidable along directions indicated by arrows A and B. A coil spring 13 is arranged between the inner wall surface of the switch case 11 and the end face of the shaft 12*a* of the trigger 12. The trigger 12 is constantly biased by the coil spring 13 in the B direction. An adjusting member 14 is rotatably mounted on the shaft 12*a* of the trigger 12. A threaded portion 14*a* is formed on the adjusting member 14 at the inner end portion of the switch case 11. The threaded portion 14*a* is located in a storage portion 12*b* whose upper surface is opened in the inner end portion of the case 11 which holds the shaft 12*a*. The threaded portion 14*a* is screwed in an engaging member 15. When the adjusting member 14 is rotated, the engaging member 15 can be moved in the storage portion 12*b* along the A or B direction in FIG. 1. A projection 15*a* is formed on the engaging member 15. The projection 15*a* extends in the storage portion 12*b*. A movable member 16 is slidably fitted in the inner end portion of the shaft 12*a* in the switch case 11, as shown in FIGS. 3 and 4(*a*). The movable member 16 and projections 12*c* and 12*d* abut against the inner surface of the switch case 11 to define an extended position of the trigger 12. A recess 16*a* is formed in the upper surface portion 16 at the same side of the opening of the storage portion 12*b*. Two ends of the projection 15*a* of the engaging member 15 can be movably fitted in the recess 16*a*. The two ends of the movable member 16 are driven together with the shaft 12*a* along the A direction when the projection 15*a* abuts against an inner surface portion 16*b* (shown in FIG. 6) of the recess 16*a* along the trigger (12) insertion direction. A metal press plate 59 is engaged with the movable member 16. An elastic engaging piece 59*a* is formed on the press plate 59. The elastic engaging piece 59*a* is located at the central portion of the storage portion 12*b*. A free end of the elastic engaging piece 59*a* is located at the trailing side of the insertion direction of the trigger 12. A projection 59*b* formed at the free end of the engaging piece 59*a* can be engaged with the upper surface of the projection 15*a* of the engaging member 15. A recess 11*b* (FIG. 1) is formed in the upper inner surface of the switch case 11 at a position where the trigger 12 projects. The recess 11*b* can receive the engaging piece 59*a*.

Actuators 19 and 20 are embedded in the movable member 16 to drive movable contact pieces 17 and 18. The actuators 19 and 20 are biased by coil springs 21 and 22 toward the movable contact pieces 17 and 18, respectively.

First and second storage portions 23 and 24 are arranged in the switch case 11. Step portions 23*a* and 24*a* are formed on the outer surfaces of the first and second storage portions 23 and 24, as shown in FIG. 4(*b*). Common contact pieces 25 and 26, slidably contacting the movable contact pieces 17 and 18 and stationary contact pieces 27, 28 and 29 switched upon movement of the movable contact pieces 17 and 18, are mounted on the step portions 23*a* and 24*a* to constitute predetermined switch mechanisms, respectively. Connecting portions 25*a*, 26*a*, 28*a* and 29*a* are formed integrally with the common contact pieces 25 and 26 and the stationary contact pieces 28 and 29, respectively. One end of each of the connecting portions 25*a*, 28*a*, 26*a* and 29*a* is set in corresponding recesses 23*b* and 23*c* (only the side in the first storage portion 23 in FIG. 3 is illustrated) via corresponding first and second storage portions 23 and 24. Terminals 30 and 31 and terminals 32 and 33 are set in the recesses 23*b* and 23*c*, respectively. Semicircular notches 25*b*, 26*b*, 28*b* and 29*b* formed at the distal ends of the connecting portions 25*a*, 26*a*, 28*a* and 29*a* are made with grooves 30*a*, 31*a*, 32*a* and 33*a* formed in the outer surfaces of the terminals 30, 31, 32 and 33, respectively. Thin plate portions 30*b*, 31*b*, 32*b* and 33*b* of the terminals 30, 31, 32 and 33, which are aligned with through holes *a* formed in the vicinity of the notches 25*b*, 26*b*, 28*b* and 29*b*, are projected by a punch to mechanically and electrically connect the terminals 30, 31, 32 and 33 and the connecting portions 25*a*, 26*a*, 28*a* and 29*a*, respectively. Lead insertion holes 30*c*, 31*c*, 32*c* and 33*c* are formed in the terminals 30, 31, 32 and 33 along longitudinal directions thereof, respectively. Screw holes 30*d*, 31*d*, 32*d* and 33*d*, engaged with threadable engagement screws (not shown), are formed perpendicular to the insertion holes 30*c*, 31*c*, 32*c* and 33*c*, respectively. Projections 23*e* and 23*f*, which define the recesses 23*b* and 23*c*, respectively, extend on portions of the first storage portion 23. The second storage portion 24 has the same construction as in the first storage portion 23 although a detailed illustration is omitted. The distal ends of metal press plates 35, 35, 36 and 37 are inserted in the insertion holes 30*c*, 31*c*, 32*c* and 33*c* in the terminals 30, 31, 32 and 33 through the corresponding lower surfaces of the projections 23*e* and 23*f*, respectively. Through holes 34*b*, 35*b*, 36*b* and 37*b* are formed in proximal end portions 34*a*, 35*a*, 36*a* and 37*a* of the press plates 34, 35, 36 and 37 to communicate with the screw holes 30*d*, 31*d*, 32*d* and 33*d* of the terminals 30, 31, 32 and 33, respectively. The proximal end portions 34*a*, 35*a*, 36*a* and 37*a* are clamped between the case 11 and the terminals 30, 31, 32 and 33. The distal ends of the metal press plates 34, 35, 36 and 37 are urged by female threaded portions (not shown), brought into threadable engagement with the screw holes 30*d*, 31*d*, 32*d* and 33*d*, so that lead wires (not shown) are inserted in the insertion holes 30*c*, 31*c*, 32*c* and 33*c* and are fixed. A recess 23*g* and a groove 23*h* are formed in the outer surface portion of the first storage portion 23 located at the side of the recess 23*c*. The recess 23*g* receives the lead wire. The groove 23*h* communicates with the recess 23*g*. The structure consisting of the recess and the groove is also provided in the vicinity of the terminal 31 in the second storage portion 24. Metal connecting members 38 and 39 having a substantially ring-like shape are fitted in the recess 23*g* and the groove 23*h*, respectively. The side surfaces of the connecting members 38 and 39 are brought into contact with the terminals 32 and 31. Free ends 38*a* and 39*a* of the connecting members 38 and 39 elastically hold the lead wire inserted in the recess 23*g*. The recess 23*g* provided with the srew holes 30*d*, 31*d*, 32*d* and 33*d* and the connecting members 38 and 39 communicates with through holes *b* formed in the switch case 11, as shown in FIG. 1.

Travel paths 40 are formed on the upper surfaces of the first and second storage portions 23 and 24. A sliding member 41 is disposed in the travel paths 40 to fit with the movable member 16, and they operate together. A projection 41*a* is formed at the center of the sliding member 41. A contact element 42 is mounted on the projection 41*a*. Contacts 42*a* and 42*b* of the contact element 42 are brought into contact with a conductor 43 and a resistor 44, which are arranged inside the travel paths 40. The conductor 43 and the resistor 44 are printed on a circuit board 45. The two ends of the circuit board 45 are fitted in notches 40*a* and 40*b* located at two ends of the travel paths 40. The notches 40*a* and 40*b* communicate with recesses 23*i* and 24*i* formed in the first and second storage portions 23 and 24 through communicating portions 46 and 47, respectively. A printed circuit board 48, constituting a velocity control circuit, is arranged in the recesses 23*i* and 24*i*. Predetermined patterned portions 48*a* and 48*b* of the printed circuit board 48 are connected to the conductor 43 and the resistor 44 by conductor coil springs 49 and 50 arranged in the communicating portions 46 and 47, respectively. A thyristor 51, as a heat-generating component among the components arranged on the printed circuit board 48, is arranged such that its heating portion 51*a* is separated from the lower surface of the printed circuit board 48, as shown in FIG. 1. A heat radiator 52 is attached to the thyristor 51. Heat generated from the heat radiator 52 is conducted to the switch case 11 through the first and second storage portions 23 and 24.

Connecting portions 27*a* and 28*a* of the stationary contact pieces 27 and 28 communicate with the recess 23*i* in the first storage portion 23. The connecting portions 27*a* and 28*a* are soldered to predetermined pattern portions 48*c* and 48*d* of the printed circuit board 48. This soldering is performed through a notch 23*j* formed in the outer surface of the first storage portion 23.

A lock member 60 is mounted on the projection 12*d* of the shaft 12*a*. The distal end of the lock member 60 extends along the inner surface of the switch case 11, as shown in FIG. 3. A lock pin 61 extends through the side wall of the switch case 11. A lock plate 62 is mounted at the inner end of the lock pin 61, which is located inside the switch case 11. A lock button 63 is mounted at the outer end of the lock pin 61, which is located outside the switch case 11. A coil spring 64 is mounted around the lock pin 61 outside the switch case 11. The lock pin 61 and the lock plate 62 are biased by the coil spring 64 in the direction indicated by arrow C.

Referring to FIGS. 1 and 3, an elastic, dustproof member 65 is held in the switch case 11 and slidable around the shaft 12*a* of the trigger 12.

Figure 5:
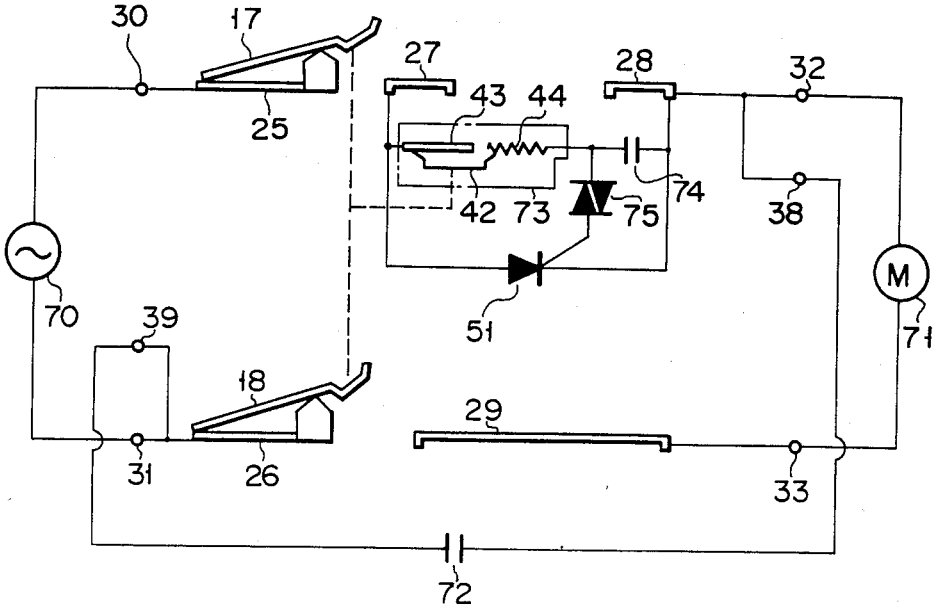
FIG. 5 shows a circuit diagram of the trigger switch.

FIG. 5 shows an electric circuit of the trigger switch. The same reference numerals as in FIG. 5 denote the same parts as in FIGS. 1 to 4, and a detailed description thereof will be omitted.

An AC power supply 70 is inserted between the terminals 30 and 31. A motor 71 is inserted between the terminals 32 and 33. A capacitor 72 is inserted between connecting members 38 and 39. The anode of the thyristor 51 is connected to the stationary contact piece 27, and the cathode thereof is connected to the stationary contact piece 28. A series circuit of a variable resistor 73 of the contact element 42, the conductor 43, the resistor 44, and the capacitor 72 is inserted between the stationary contact pieces 27 and 28. A common node between the variable resistor 73 and a capacitor 74 is connected to the gate of the thyristor 51 through a bidirectional thyristor 75.

The operation of the trigger switch having the above arrangement will now be described. Assume that the trigger 12 extends as shown in FIGS. 1 and 3, and that the switch mechanisms and the velocity control circuits are kept off.

Figure 6:
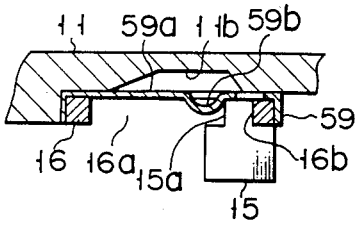
FIGS. 6(*a*) to 6(*d*) are side sectional views showing the main part of the trigger switch so as to explain its operation.
Figure 6:
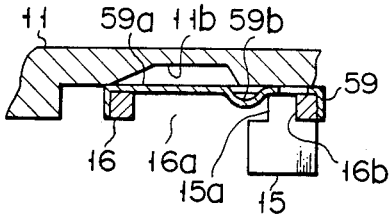
Figure 6:
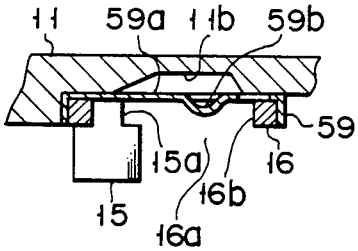
Figure 6:
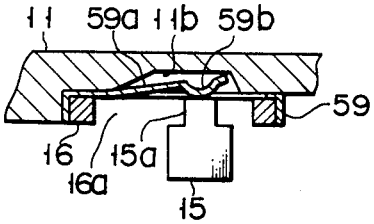
Figure 7:
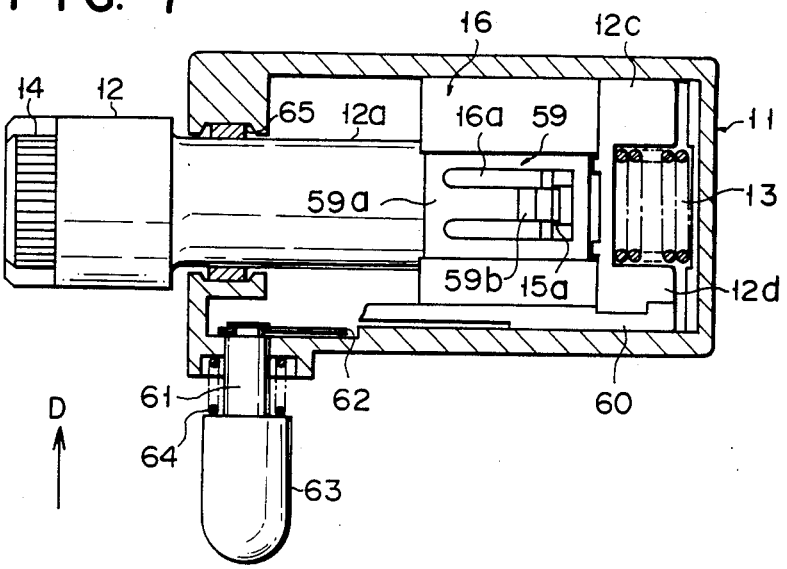
FIGS. 7 and 8 are partial plan views for explaining the operation of the trigger switch.

The engaging member 15 is located in the storage portion 12*b* near the adjusting screw 14 at the distal end along the withdrawal direction of the trigger, as shown in FIGS. 1 and 3. In this state, when the trigger 12 is withdrawn along the A direction, the movable member 16 is moved along the A direction. As shown in FIG. 6(*a*), the projection 15*a* of the engaging member 15 abuts against the withdrawal direction inner surface (stop portion) defining the recess 16*a* of the movable member 16. The engaging member 15 is moved together with the trigger 12, as shown in FIG. 6(*b*). Upon movement of the engaging member 15, the switch mechanism is turned on. At the same time, the contact element 42 formed on the movable member 16 slides along the conductor 43 and the resistor 44, so that the resistance changes to gradually increase power supplied to the motor 71. As shown in FIG. 7, when the trigger 12 is completely withdrawn, maximum power is supplied to the motor 71. In this state, when the lock button 63 is moved in the D direction, the lockplate 62 opposes the lock member 60. When the trigger 12 is released, lock plate 62 is urged to and engaged with the lock member 60. Therefore, the withdrawal state of the trigger 12 is thus held. When the trigger 12 is slightly withdrawn, the lock plate 62 is disengaged from the lock member 60. The lock button 63 is biased by the biasing force of the spring 64 to automatically return to the position shown in FIG. 7. In this state, when the trigger 12 is released, the trigger 12 is extended by the biasing force of the return spring 13 in the extension direction (the B direction in FIG. 1). In this case, the projection 15*a* of the engaging member 15 abuts against the projection 59*b* formed on the stop piece 59*a* of the press plate 59. In the state wherein the trigger 12 is withdrawn, the engaging piece 59*a* abuts against the inner upper surface of the switch case 11, so that the force acting on the projection 15*a* acts on the projection 59*b*. Therefore, when the trigger 12 is driven along the extension direction, the movable member 16 is driven through the press plate 59. The power supplied to the motor 71 is gradually decreased, and the OFF state shown in FIGS. 1 and 3 is restored.

Figure 8:
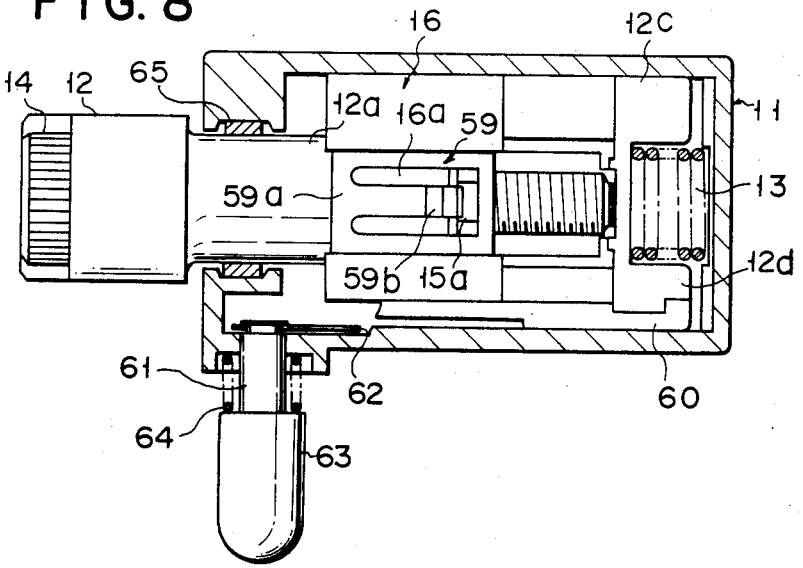

An operation will be described wherein the adjusting member 14 is rotated to locate the engaging member 15 at the most withdrawn position of the trigger 12 within the storage portion 12*b*, as shown in FIG. 6(*c*). In this state, when the trigger 12 is withdrawn, the projection 15*a* of the engaging member 15 pushes the projection 59*b* on the engaging piece 59*a*of the press plate 59 upward, as shown in FIG. 6(*d*). In other words, the withdrawal operation of the trigger 12 causes the projection of the engaging member 15 to move together with the shaft 12*a* in the recess 16*a* of the movable member 16. The movable member 16 will not be driven. The engaging piece 59*a* of the press plate 59 opposes the recess 11*b* in the switch case 11. The engaging piece 59*a* is moved in synchronism with the movement of the engaging member 15. The projection 59*b* on the engaging piece 59*a* is engaged with the projection 15*a* of the engaging member 15. When the trigger 12 is further withdrawn, the projection 15*a* of the engaging member 15 abuts against the inner surface of the recess 16*a* of the movable member 16, as shown in FIG. 6(*a*). When the trigger 12 is withdrawn still further, the movable member 16 is driven, as shown in FIG. 6(*b*). The subsequent operation is the same as described above. The state wherein the trigger 12 is fully withdrawn is illustrated in FIG. 8. In this state, even if the trigger 12 is fully withdrawn, the power supplied to the motor 71 will not be maximum. In this case, a predetermined power set by the adjusting member 14 is supplied to the motor 71. When the trigger 12 is released, the trigger 12 is driven along the extension direction. Upon extension of the trigger 12, the movable member 16 is also driven along the extension direction. However, the operation is performed in an opposite order (i.e., states shown in FIGS. 6(*b*), 6(*a*), 6(*d*) and 6(*c*) in the order named). The trigger switch is set in the OFF state shown in FIGS. 1 and 3.

According to the arrangement described above, the heating portion 51*a* of the thyristor 51 as a heat-generating component is separated from the printed circuit board 48. Therefore, heat generated from the thyristor 51 and transmitted to the printed circuit board 48 can be minimized. Furthermore, the resistor 44 is separated from the printed circuit board 48, and the predetermined pattern portion 48*b* of the printed circuit board 48 is connected to the resistor 44 through the coil spring 50. Therefore, the heat generated from the printed circuit board 48 will not be substantially conducted to the resistor 44. A change in resistance of the resistor 44 can be prevented, thereby performing stable velocity control.

According to the arrangement described above, the projection 15*a* on the engaging member 15 threadably engaged with the adjusting member 14, can be engaged with the inner surface of the recess 16*a* of the movable member 16. A displacement of the movable member 16 is adjusted by the adjusting member 14 so as to perform velocity control of the motor 71. In any adjusting state, the trigger 12 can be fully withdrawn. An excessive force excluding the force for driving the movable member 16 will not act on the engaging member 15 and the adjusting member 14. As a result, the engaging member 15 and the adjusting member 14 will not be damaged.

The adjusting member 14 is inserted in the shaft 12*a* and will not be exposed outside. The adjusting member 14 will not be contaminated with dust or the like.

The portion of the shaft 12*a* which is located outside the switch case 11 does not have a recess or projection. Therefore, a dustproof structure can be obtained by the dustproof member 65.

Although the movable member 16 is operated simultaneously or in a delayed manner upon withdrawal of the trigger 12, the movable member 16 can be simultaneously moved together with the trigger 12 in the return mode. Therefore, a decrease in velocity of the motor 71 will not be delayed upon extension of the trigger 12. As a result, the operabililty is good and the operation is safe.

Figure 9:
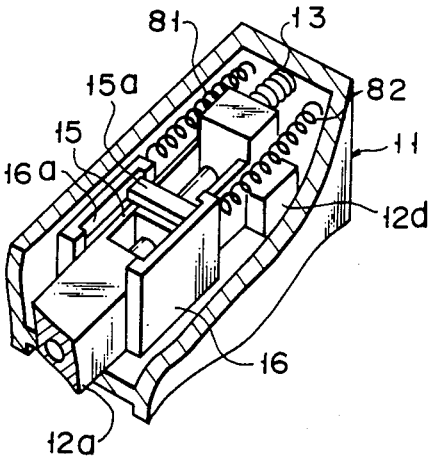
FIG. 9 is a perspective view of the main part showing another construction of a movable member return mechanism.

In the above embodiment, the movable member 16 returns in such a manner that the projection 59*b* on the engaging piece 59*a* of the press plate 59 is engaged with the projection 15*a* on the engaging member 15. However, the return operation of the movable member 16 is not limited to this. For example, as shown in FIG. 9, springs 81 and 82 may be arranged between the movable member 16 and the inner surface of the switch case 11 to bias the trigger 12 in the extension direction. In this case, the recess 11*b* of the press plate 59 need not be used.

What is claimed is:

1. A trigger switch for changing the resistance of a variable resistor connected to a velocity control circuit upon operating a trigger, comprising:

a switch case;

a trigger disposed to be extended/withdrawn with respect to said switch case;

a contact element arranged in said switch case and interlocked with an operation of said trigger;

first and second storage portions integrally formed in said switch case;

a resistor arranged at the periphery of said first and said second storage portions, wherein said contact element is slidable along said resistor;

a printed circuit board arranged in said first and said second storage portions of said switch case;

an elastic connecting member, provided in said first and said second storage portions, for electrically connecting one side surface of said printed circuit board and said resistor; and a heating-generating component arranged on the other side surface of said printed circuit board, said heat-generating component forming part of said velocity control circuit;

whereby substantially all of the heat produced by said heat-generating component is radiated to the outside and prevented from affecting the resistance value of said resistor.

2. A trigger switch according to claim 1, wherein said heat-generating component comprises a thyristor.

3. A trigger switch according to claim 1, wherein contact pieces of a switch mechanism, and external connecting terminals connected to said contact pieces are arranged on the periphery of said first and said second storage portions.

4. A trigger switch for changing the resistance of a variable resistor connected to a velocity control circuit upon trigger operation, comprising:

a switch case for containing said velocity control circuit;

a trigger arranged such that a shaft thereof extends or is withdrawn with respect to said switch case;

an elastic member, arranged inside said switch case, for urging said trigger in a direction in which said trigger projects from said switch case;

a storage portion formed at an inner end portion of said shaft which is located in said switch case;

adjusting means rotatably arranged inside said shaft of said trigger and having a threaded portion located inside said storage portion;

an engaging member threadedly engaged with said threaded portion to be moved within said storage portion upon rotation of said adjusting means;

a movable member slidably arranged at an inner end of said shaft which is located in said switch case, said movable member being moved by said engaging member upon withdrawal of said trigger for changing the resistance of the variable resistor; and restoring means for restoring said movable member in the direction in which said trigger projects from said switch case.

5. A trigger switch according to claim 4, wherein said restoring means comprises a press plate which is provided in said movable member and which has a projection to be engaged with said engaging member.

6. A trigger switch according to claim 4, wherein said restoring means comprises a coil spring arranged between the inner surface of said switch case and said movable member.

7. A trigger switch according to claim 4, wherein a dustproof member is arranged around said shaft in said switch case.

8. A trigger switch according to claim 1, wherein said elastic connecting member comprises a coil spring.

* * * * *